US009127919B2

(12) United States Patent
Holland

(10) Patent No.: US 9,127,919 B2
(45) Date of Patent: Sep. 8, 2015

(54) HAND-LOADING DEVICE, SYSTEM, AND METHOD

(71) Applicant: Darrell Holland, Powers, OR (US)

(72) Inventor: Darrell Holland, Powers, OR (US)

( * ) Notice: Subject to any disclaimer, the term of this patent is extended or adjusted under 35 U.S.C. 154(b) by 0 days.

(21) Appl. No.: 14/459,490

(22) Filed: Aug. 14, 2014

(65) Prior Publication Data

US 2015/0053071 A1 Feb. 26, 2015

Related U.S. Application Data

(60) Provisional application No. 61/867,779, filed on Aug. 20, 2013.

(51) Int. Cl.
*F42B 33/04* (2006.01)

(52) U.S. Cl.
CPC ..... *F42B 33/04* (2013.01)

(58) Field of Classification Search
CPC ..... F42B 33/04; F42B 33/10; F42B 33/00
USPC ..... 86/18, 19.5, 19.7, 10, 23, 32, 36
See application file for complete search history.

(56) References Cited

U.S. PATENT DOCUMENTS

| | | | | |
|---|---|---|---|---|
| 3,049,044 | A | 8/1962 | English | |
| 3,313,201 | A * | 4/1967 | Lawrence | 86/32 |
| 4,222,305 | A | 9/1980 | Lee | |
| 5,025,706 | A | 6/1991 | Markle | |
| 5,341,717 | A * | 8/1994 | Feldman | 86/32 |
| 5,693,905 | A * | 12/1997 | Blodgett et al. | 86/32 |
| 6,260,463 | B1 | 7/2001 | Brand et al. | |

* cited by examiner

*Primary Examiner* — Jonathan C Weber
(74) *Attorney, Agent, or Firm* — Peter A Haas Esquire LLC

(57) ABSTRACT

A system for reloading a cartridge including seating a primer in the cartridge for use in a predetermined firing chamber includes at least one reloading die and reloading shim adapted to selectively insert into the chamber. A desired seating depth is determined and an offset factor is determined using a primer pocket depth, a primer height, and the seating depth. This calculated dimension is transferred to a primer-seating press. The primer-seating press includes an arm hingeably configured to operate in a first position, a second position, and a third position; a cross pin configures on the press horizontally and selectively slides from a retracted position to an extended position and an adjustable stop disposed on the arm. The stop is pre-set to using the calculated dimension to limit travel of the arm by cooperating with the cross pin. The seating press includes a vertically arranged piston operated by the arm.

11 Claims, 5 Drawing Sheets

HAND-LOADING DEVICE, SYSTEM, AND METHOD

PRIORITY CLAIM

The present application claims benefit under 35 USC Section 119(e) of U.S. Provisional Patent Application Ser. No. 61/867,779 filed on 2013 Aug. 20: The present application is based on and claims priority from this application, the disclosure of which is hereby expressly incorporated herein by reference.

FIELD OF THE INVENTION

The present invention relates generally to a system to improve accuracy of firearms, particularly firearms that use cartridges that are prepared by hand. More specifically, the present invention relates to a system that improves the hand loading process of a cartridge and includes a cooperating die-sizing gauge and shim set and an improved primer-seating device for hand loading ammunition cartridges.

BACKGROUND

Hand-loading cartridges (also called reloading) is a manual process of loading and assembling firearm cartridges or shotgun shells from individual components including, for example, a case (or hull), primer, powder, and bullet (or shot).

The accuracy of a rifle shot, or other small-arms intentional discharge, significantly increases when the shooter uses a hand-loaded cartridge compared to a bulk, "off-the-shelf" premade cartridge. This improved accuracy, in part, is a result of less variability in weight and balance obtained by precise hand loading of the cartridges. Commercially purchased, pre-assembled, bulk quantities of cartridges, often have a higher variability in weight and balance, which contributes to inaccuracies and variability shot to shot.

Hobbyists, professionals, and recreational shooters often elect to hand-load cartridges—not only for the enjoyment of the task—but also to reduce or eliminate variables that prevent repeatable performance. Further, the hand loading of cartridges enables the shooter to customize the round for the task at hand, whether it is competitive shooting events, hunting, or target practice. Accordingly, customized rounds may be constructed to optimize specific performance parameters such as bullet velocity, accuracy between firings, and shot-to-shot consistency.

The hand-loading process can realize increased accuracy and precision through improved consistency of manufacture, by selecting the optimal bullet weight and design, and by tailoring bullet velocity to the purpose. Each reloaded cartridge can have each component carefully matched to the rest of the cartridges in the batch. Brass cases can be matched by volume, weight, and concentricity, bullets by weight and design, powder charges by weight, type, case filling (amount of total usable case capacity filled by charge), and packing scheme (characteristics of granule packing).

In addition to these critical items, the equipment used to assemble the cartridge also has an effect on its uniformity/consistency and optimal shape/size. Normally, a reloading die is used to size the cartridges to more precisely match the cartridge to the exact size of the chamber in a given firearm. Typical reloading die kits are available, for example, from Sinclair International (www.sinclairintl.com) and are manufactured by Lee Precision, Inc. such as model number 100-010-122WS for hand guns or a Redding (manufacturer) Type-S model number 749-007-898 WS die set for rifles.

Guns and reloading dies have been made for over a century; however there has never been a reliable, accurate way to adjust a loading die for a specific rifle/pistol chamber. In part, the difficulty in adjusting a loading die for a specific chamber is due to inherent variation in the tolerances maintained during the manufacturing of the various components and tools. Modern manufacturing processes will yield highly predictable results in the tolerances of the parts they produce, but a natural, statistical distribution of sizes remains part of the controlled process. This natural variation, when compounded for each component used in assembly of a round, plus the natural, accepted variation in the tools used to measure the components and the natural variation inherent in the firing components, results in a stacked variation that is manifested as shot inconsistency.

To counter this shot inconsistency, some shooters will try a rudimentary sorting of the components in an attempt to size the round to the chamber. This may reduce the shot-to-shot variation experienced by the variation in tolerances that are inherent in the manufacturing of chambers, reloading dies, shell holders and loading presses, all of which contribute to the difficulty and inaccuracy of improper die adjustment. However, there is not a systemic, proven, repeatable method or system or tool that enables a shooter to consistently improve the selection of components and reloading process. Thus, much of the current hand reloading process is based solely on an artful combination of long-practiced, experience-based skill and some guesswork.

Further, hand reloading is not without inherent danger. For a given firearm, improperly adjusted dies can be dangerous. For example, if the shoulder of the cartridge is pushed back, this creates excessive headspace in the firearm, which can result in a case head separation, causing the firearm to explode when pressures from the cartridge escape. Likewise, if the die is not adjusted properly and the shoulder of the cartridge is not pushed back sufficiently, the cartridge will not chamber in the firearm.

Obtaining the proper results of hand-loaded ammunition—thus far—is only achieved thru trial-and-error attempts by the hand-loader. In the current art to achieve the desired setting a cartridge needs to be fired and reloaded several times until the action of the bolt becomes hard to close. The hand loader then attempts to screw the die down progressively until the shoulder of the cartridge is compressed and sized enough to allow chambering. Acceptable tolerances in chamber dimensions usually run or vary from about 0.000 to 0.006-inches. If the cartridge is re-sized repeatedly with a 0.006-inch headspace, head separation is inevitable after repeated firings.

Reloading dies also have tolerances and the usual reference is to screw the die down against the shell holder (which also has tolerances) hoping to size the cartridge sufficiently to chamber, yet not be sized to the point of being dangerous by tolerance variations in dies and shell holders.

Reloading dies are generally sold in sets of two or three dies, depending on the shape of the case. The first die typically is used to size and de-cap, and expand the neck. The last die in the set seats the bullet and may apply a crimp. Special crimping dies are often used to apply a stronger crimp after the bullet is seated.

Reloading dies work in conjunction with a press. Once the appropriate die is selected and loaded with a cartridge case, they are positioned under a ram of a die that then forces the case to conform to the wall of the die, or—depending on the operation—crimp the case, or seat a primer.

Seating the primer is another important step in hand loading a cartridge. Again, the hand loading operation is attempting to create a very tight, repeatable, and exact tolerance match between the finished cartridge and the firing chamber of a given firearm. However, because of the complicated stack up of tolerances, which are unique to each hand-loader's set up, for over a century primers have been seated by feel. This is a highly variable, highly subjective, and skill-intensive manual operation and no two people have the same feel. This subjective feel results in crushed and irregular seated primers, which in turn result in misfires and poor ignition qualities. Currently, all hand-held and bench mounted priming tools are used by this subjective "feel technique."

This highly variable feel technique to self-loading ammunition is counter-productive for recreational and competitive shooters. To improve target consistency shooters desire a reduction in variables that affect their shots. Although little can be done for ambient lighting, wind, and weather (outdoors), one variable in control of the shooter is attaining a repeatable and consistent muzzle velocity. Once factor contributing to muzzle velocity is proper seating of the primer.

Achieving a low standard deviation in muzzle velocities is the key to long range shooting success and victory over other competitors. Eliminating the vertical stringing in group size by achieving single digit velocities (low standard deviations in velocity) is most important to long range shooters, which are greatly impacted by the duration of the flight and gravity action on the shot due to the extreme ranges involved.

Primer seating and depth of the primer seated contribute to consistent ignition, which in-turn relates to low deviations in velocity. As primer pockets expand, the feel one is expected to know, changes, and this results in inconsistent seating depth, which affects velocity and ignition. The depth at which the primer seats has a significant impact on the behavior of the ammunition both during firing and after it leaves the muzzle. For example, firing pin protrusion and inertia energy ignite the primer in the cartridge case, thus when the primer is seated to irregular depths, protrusion and ignition are affected and this results in inconsistent ignition, misfires and extreme spreads in velocities from projectile to projectile during a shooting session.

When primers are seated consistently to an exact depth, the consistency of the spark produced by the primer, which ignites the powder column, is improved. Spark ignition, spark intensity, and cone of spark fire all contribute to uniform burn rates and low standard deviations in muzzle velocity.

When primers are seated to the bottom of the primer pocket in the cartridge case, the pressure developed from burning powder pushes the primer back against the bolt-face; this—in turn—interrupts the harmonic node traveling down the barrel. And, this results in inconsistent timing and exit of the bullet from the barrel and affects accuracy. Minimizing and or eliminating "primer back-up" by properly seating the primer is therefore of paramount importance as it negates harmonic interruption.

English, in U.S. Pat. No. 3,049,044 issued on 1962 Aug. 14, teaches one representative example of known devices and methods for seating primers in a cartridge. Lee, in U.S. Pat. No. 4,222,305 issued on 1980 Sep. 16, teaches another hand tool for installing (seating) primers in ammunition cartridges. Both of these aforementioned teaching in the art rely on the feel technique for setting the desired primer position relative to the bottom of the shell or casing and further rely solely on a threaded member for infinite adjustability of this seating position. Yet another hand-held tool for seating a primer includes the disclosure of Brand et el. in U.S. Pat. No. 6,260,463 issued 2001 Jul. 17.

Markle, in U.S. Pat. No. 5,025,706 issued 1991 Jun. 25, teaches a bench-mounted, controlled-depth primer-seating tool that includes a dial measurement component.

Despite the known teachings in the art, there is yet still a need for a device and system that ensures proper primer seating and consistent, repeatable primer seating for the hand loading of ammunition.

SUMMARY OF THE INVENTION

The present invention overcomes a common problem in the current state of the reloading cartridges to improve shot-to-shot consistency. The present invention improves sizing cartridges for a given chamber and improves the seating of a primer in a cartridge.

The present invention contemplates both a preferred method and unique devices. As a result, the present invention provides a more reliable, easier to use, and more repeatable reloading and seating process. First, the present invention includes a unique reloading die and gauge set for consistently pairing a hand-loaded cartridge to a given firearm so that shot-consistency is greatly improved over the known teachings in the art.

Second, the present invention includes a modified press, a primer seating press, to enable repeatable, reliable, efficient, and consistent primer seating in a cartridge.

Third, the present invention includes a method of using the devices to improve the entire reloading process.

For example, to achieve proper seating, the hand-reloader must sort primers according to height. A primer can be measured for overall height using calipers, for example. And, the primer pockets in each cartridge must be made uniform. Then, the handloader determines the desired seat depth relative to the bottom of the cartridge. Using these dimensions, an offset is calculated. This offset is transferred to a unique primer seating press. Specifically, a stop is set up by turning the stop clockwise or counter-clockwise to extend or retract the stop's position on an arm. Once set up, the primer seating press precisely seats primers in cartridges based on a perfect measured seating depth, which eliminates the old feel technique currently used in the art.

DRAWING

DESCRIPTION OF THE INVENTION

Figure 1:
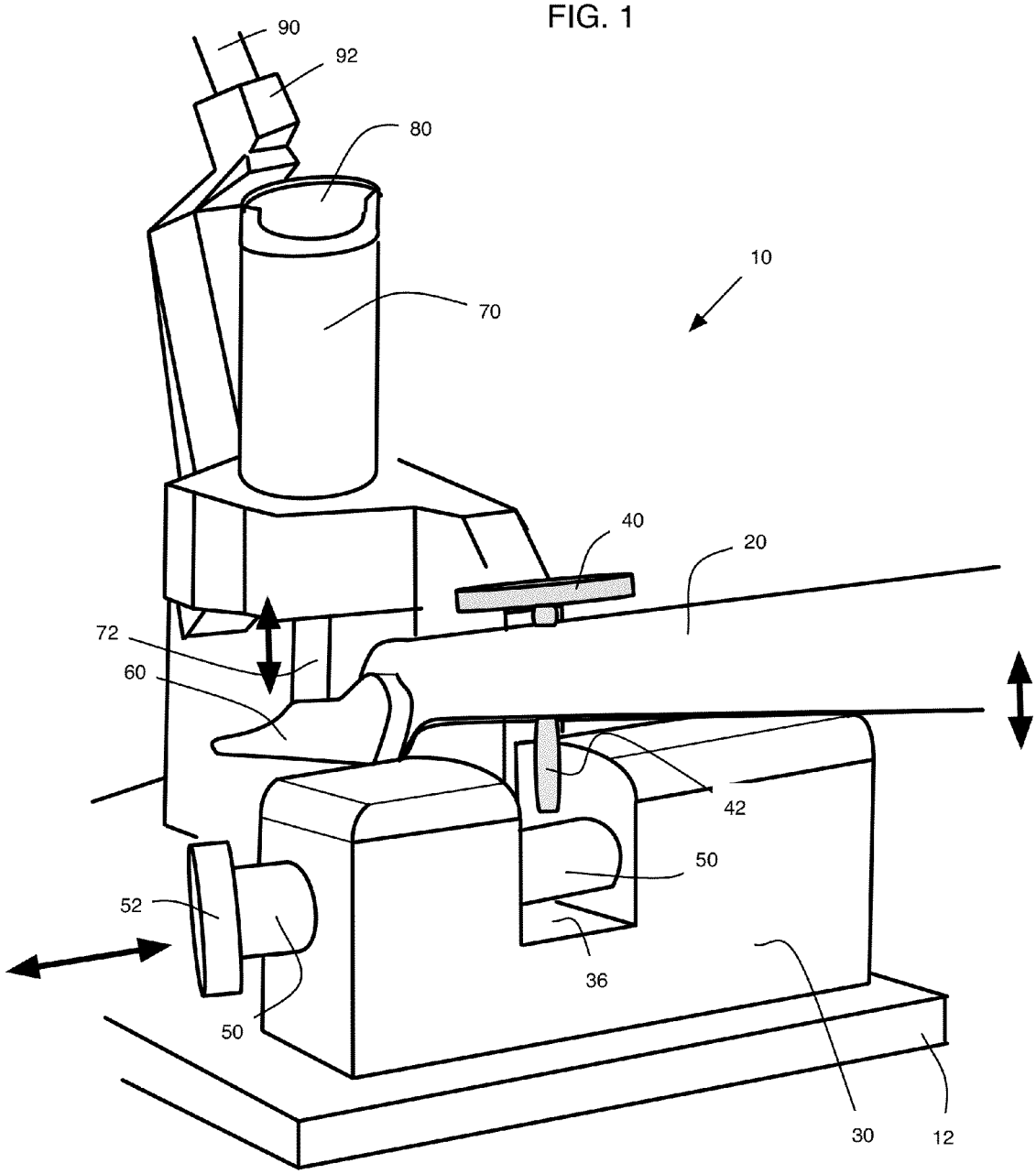
FIG. 1 is an offset frontal view of one embodiment according to the present invention.

Possible embodiments will now be described with reference to the drawings and those skilled in the art will understand that alternative configurations and combinations of components may be substituted without subtracting from the invention. Also, in some figures certain components are omitted to more clearly illustrate the invention.

Hand loading cartridges is an art and practice enjoyed by many recreational shooters (such shooters may be called "reloaders," hand loaders," or "users", for example), and for competitive shooters, hand loading can improve the shooter's performance by removing some variables shot-to-shot. However, the art of hand loading is fraught with perils for both the uninitiated and seasoned reloaders. Such perils result when a primer is improperly seated into the base (case head) of the cartridge. A properly seated primer typically positions flush with the bottom (at crush) of—or just slightly recessed (or below crush) the case head, or slightly extended from the bottom of the cartridge (above crush). However, due to dimensional tolerance variances from cartridge to cartridge, and normal dimensional tolerances in the firearm's firing mechanism, and in the fixtures used to traditionally seat primers, there can be an unacceptable positioning (seating) of the primer whereby the primer may stand-proud from the base, or be extended too far inward from the base.

Further variation is introduced with the current teaching in the art that instructs setting a primer based on a somewhat arbitrary positioning or feel. First, the current art teaches seating a primer and verifying its depth using a straight-edge to verify that the primer isn't standing proud relative to the base of the cartridge and using a visual inspection to assure that it isn't inserted too deep below the base of the cartridge. Further, the current art teaches inserting a cartridge in the firearm's chamber and to feel when the trigger/firing pin action is overly restricted—indicating an improper seating, then re-doing the set up, seating yet another primer in a cartridge, and again "feeling" the action of the firing pin to verify proper seating. This prior-art method introduces significant variability cartridge to cartridge. Also, this prior art method instructs using a conventional reloading die to force the primer into an opening on the base of the cartridge. But, due to the extremely close tolerances between the outer diameter of the primer and the inner diameter of the opening on the cartridge—a necessary interference tolerance to prevent unwanted back discharging of the explosive combustion when the primer is struck—the art of feel was developed to properly position (in depth) the primer.

An improperly seated primer can be dangerous. If the primer extends to far above the surface of the bottom (above crush) of the cartridge, pre-ignition of the round can occur. Oppositely, should the primer be recessed to far inside the cartridge (below crush), the primer will not properly contact the striker during firing, resulting in a misfire. Neither option is desirable as both can allow a dangerous discharge of the explosive gases when the firing pin strikes the primer. Thus, there is considerable teaching in the art on how to obtain the proper feel when using a die to insert the primer to the proper depth relative to the base (case head) of the cartridge.

In contrast, the present invention eliminates feel and instead includes a system, tool, and method using the system and tools and measurements to efficiently, reliably, and safely seat primers in cartridges, as will be detailed, below.

Also, the present invention contemplates the use of unique reloading sizing-die gauge ("reloading die") and shims to properly size cartridge brass for a given firearm, to further reduce variability shot-to-shot, yet allow the reloader to load several cartridges during one set-up of the reloading equipment, so that the reloading process is more efficient, accurate, and safe for the reloader. The unique combination of a unique reloading die and reloading shim set enables the reloader to transfer this critical dimension to a conventional or modified reloading press without using calipers or other measuring devices. This, in itself, is a huge improvement over the status quo.

The present invention improves the current teaching of seating primers in cartridges using a modified or a conventional reloading press. The present invention includes a unique configuration of devices to ensure proper seating of the cartridge to a precise, predetermined level on any cartridge that is sized for the particular firearm of interest. When used to seat a primer, the present invention uses a modified reloading press that includes adjustable stops that, once set for a given cartridge and particular firearm, enable the reloader to repeatably seat primers at a precise location relative to a very consistent dimensional feature of the cartridge.

Accordingly, those skilled in the art will appreciate that the various contemplated and preferred embodiments of the present invention—which include a device, system, and method of seating the primer—eliminates the skill of feel, and instead rely on physical geometries of fairly stable dimensional aspects of the various components and tools that can quickly and accurately be set up for repeatable seating of primers. In applying the teachings of the present invention, the highly variable, and skill intense feel is taken out of the equation. Instead the shooter/hand-loader now has the ability to seat primers to exact depths in all configurations. Further, this setting is custom tailored to a particular firearm/cartridge combination, and once set up, provides a highly repeatable method to seat a plurality of primers in a plurality of cartridges whereby the primers of a first predetermined size and the cartridges are of a second predetermined size.

One key aspect of the present invention is that the system, method, and device each relies on a fairly consistent, dimensionally stable feature manufactured in present-day cartridges. To better appreciate the present invention, a short discussion of ammunition cartridges is in order. First, when cartridge brass is manufactured, rim thickness is machined into the case with a very close tolerance. Rim thickness is the most consistent and precise tolerance in the construction of a cartridge case. This rim thickness varies in specific calibers as specified by SAAMI standards. Examples include: small base cartridges such as 22 Hornet, 218 Bee, 222 Rem., and 223 Rem., for example, standard (Std.) base cartridges such as 308-, 30-06, etc., Magnum cases with belted headspace shoulder, i.e. 7 mm Mag, 300 Win., Mag etc. and un-belted magnum cartridges such as 300 WSM, 243 WSSM, and 300 RUM-SAUM based rounds. Thus, by utilizing this precise rim thickness feature to determine dimensional relationships without measuring using a calipers, the present invention can accurately, repeatably, consistently, safely, and reliable seat primers in precise position in the cartridge. Thus, once the device of the present invention is set up for a given cartridge for use in a given firearm, the reloader can rapidly seat primers in cartridges in precisely the correct position.

According to the preferred methods and using preferred embodiments of the present invention, a reloader can positively and repeatably seat primers with unheard of accuracy in seating depth irrespective of primer pocket diameter (which varies depending on whether the cartridge is worn, loose, or new). The "Feel Technique" as prescribed by other manufacturers has been obsoleted with this invention.

This invention applies to the RCBS (a manufacturer and seller of reloading equipment, available at www.rcbs.com, for example) auto-primer and/but can also be implemented to other handheld/bench mounted priming units/machines as well.

Improved Reloading Method and Devices:

Any given firearm has a chamber that is somewhat imprecise in size due to natural tolerances that occur during manufacturing. There are many variables, components, dimensions, and tolerance ranges for a given firearm. Thus, a shooter that can precisely match the chamber size of his firearm and correlate that size to selecting an appropriately sized cartridge for hand loading will be rewarded with more consistent shots.

The present invention provides a method, system, and repeatable tools or devices that mimic the tried-and-true "experimentation" (feel) technique of sizing a cartridge to a chamber by firing and reloading a cartridge several times until the action/bolt becomes hard to close. The present invention replaces the cartridge with a standardized sizing (reloading) gauge-die and provides several shim gauges of varying thicknesses that work with the sizing (reloading) gauge-die. Thus, in a rifle application, the hand loader simply removes the firing pin assembly from the bolt, as well as the constant tension ejector if it has one, then inserts the present invention's reloading die-sizing gauge into the chamber and closes the bolt. If the bolt closes with no resistance, the hand loader then inserts the 0.002 shim inside the bolt face and closes the bolt. This process will continue if necessary and the hand loader will continue adding shims (in sequential order) until a slight amount of resistance is felt. This tells the hand loader that the correct chamber length/dimension has been achieved for that specific rifle. By reading and adding the sum of the tolerances as stamped on the shims and reloading die-sizing gauge, the hand loader can easily determine the unique dimension of his or her firing chamber for that given firearm. This dimension can now be transferred to a conventional press and reloading die with a shell holder:

Then, once the correct and adjusted dimension has been achieved via the rifle's chamber, the reloading gauge and shims are placed in the shell holder and the reloading die is screwed down to touch the corresponding shoulder angle of the gauge, the reloading die's lock ring is then tightened to maintain point of contact. This precise method eliminates the trial and error method used in the past.

Maximum brass life, accuracy and most importantly safety are now assured due to precise reloading die settings having used an adjustable chamber gauge. Shims provided with each gauge are in 0.001, 0.002 0.003, 0.004, and 0.005 (inches) thickness, for example. These thicknesses when used with the gauge will compensate for any manufacturer tolerance provided by the SAAMI institute.

An added result of the method and device of the present invention is accuracy. By minimal sizing of the cartridge for a specific chamber, the bullets relationship to the bore is also improved. This results in consistent harmonic node departure of the bullet from the barrel. Accurate hand-loads are developed by this node perfection, resulting from proper powder charges/weights and seating depths. For optimum accuracy, the timing of the harmonic node needs to be at the receiver, when the bullet exits the bore. This minimizes the barrels oscillation at the muzzle. Harmonic vibration travels at approximately 18,000 feet per second. A few thousands change in seating depth from improperly sized cartridges can affect accuracy by changing the bullets departure/exit from the muzzle relative to the above mentioned oscillation.

Another preferred embodiment contemplates another method for determining the proper offset of a firearm chamber. Here, the firearm includes a firing pin assembly and bolt. This method includes providing at least one reloading die-sizing gauge configured to insert in the firearm chamber. Providing at least one reloading shim gauge configured to cooperate with the reloading die gauge and inserting it into the firing chamber. Removing the firing pin from the bolt. Inserting the reloading die-sizing gauge into the firearm chamber and closing the bolt. Determining any resistance when closing the bolt. If the bolt closes with no resistance, inserting the at least one (reloading) shim gauge into the bolt face. And then, transferring the die-sizing gauge and any shims to a die-set on a press to enable the press to be set up for the correct chamber length. Then setting up a reloading press conventionally but where the dimensions for setting up the press are taken from the reloading die and shim set as just described, above. Finally, any constant offset, such as a 0.002-inch offset may be used to further properly set up the reloading die on the press.

Figure 4:
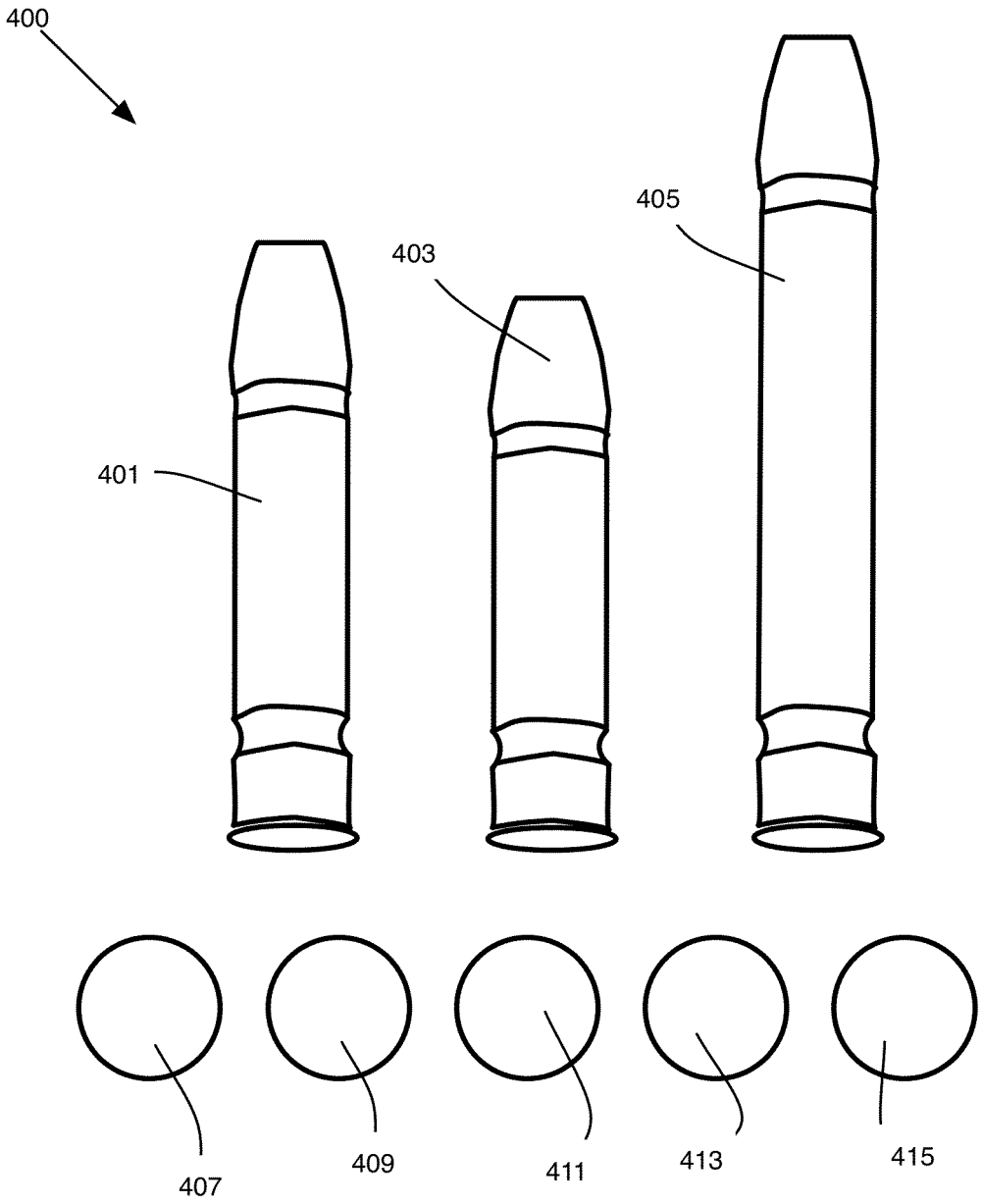
FIG. 4 is a front view of a sizing die and shim gauge set according to one embodiment of the present invention.

FIG. 4 illustrates a set 400 of gauging dies and measured shims consisting of three sized dies (401, 403, and 405) and five sized shims (407, 409, 411, 413, and 415). The gauging dies correspond to standard cartridge sizes include, for example, 0.001, 0.002, 0.003, 0.004, and 0.005 thickness shims; however, other sized shims could also work. Maximum brass life, accuracy, and most importantly, safety are now assured due to precise die settings having used an adjustable chamber gauge. Shims provided with each gauge are in 0.001, 0.002, 0.003, 0.004, and 0.005 thicknesses. These thicknesses when used with the gauge will compensate for any manufacturer tolerance provided by the SAAMI institute An example of hand-loading cartridges for a rifle will aid in understanding how the reloading gauging dies and reloading shim set 400 works. Accordingly, in a rifle application, one simply removes the firing pin assembly from the bolt as well as the constant tension ejector if it has one 501. Then, select 503 the appropriate reloading die-sizing gauge from the reloading set 400 (based on the caliber or the rifle and desired cartridge shell being used) and insert the reloading die-sizing gauge into the chamber and close the bolt 505. Next, assess the resistance encountered when closing the bolt 507—if the bolt closes with no resistance 508, then begin inserting the smallest reloading shim and again assess the resistance when closing the bolt, continue inserting 509 shims and or replacing shims until resistance is encountered. Thus, first insert the 0.002-shim inside the bolt face and close the bolt. Continue adding shims (in sequential order) until a slight amount of resistance is encountered. When this slight resistance is encountered, the reloader then notes which combination of gauging die and shims are in the chamber 511. The combination of gauging die and shims (if any shims) is a direct relation to the chamber length/dimension needed to properly size primers during the hand loading process. The hand loader can add up the dimensions indicated by the combination of gauging die and shims (if any) or simply note the physical arrangement of the set.

With this correct chamber length/dimension determined for that specific rifle (represented by the specific combination of die gauge and shims (if any)), this dimension can now be transferred 513 to the die and shell holder using the same gauge/shim combination. Accordingly, the reloading gauge and shims are placed 515 in the shell holder cup 80 (on the modified seating press 10) and a seating die is screwed down in relation to the piston of the press, as would be understood conventionally. However, importantly, the present invention transfers a shoulder dimension using the present invention's reloading die (and any combination of reloading shims, if applicable) to the modified press 10. By using a constant offset of 0.002-inches plus the exact set of reloading die and shims used above, the die and piston travel distance is established and set up. This point of contact is transferred to the die's lock ring, and then tightened to maintain this point of contact.

Improved Primer Seating Method and Devices:

The present invention further contemplates a method, system, and device that repeatably seats primers to a predetermined depth. By utilizing a cartridge's rim thickness, which is one of the most precise dimensions on manufactured cartridges, in conjunction with an infinitely adjustable physical stop in the seating handle of a novel primer press/tool, a user (hand-loader) can repeatably seat primers with unheard of accuracy in seating depth irrespective of primer pocket diameter (which varies depending on whether the cartridge is worn, loose, or new, or varies from manufacturer to manufacture, or even within a lot from the same manufacturer). The "Feel Technique" as prescribed by other manufacturers has been obsoleted with this invention.

Figure 2:
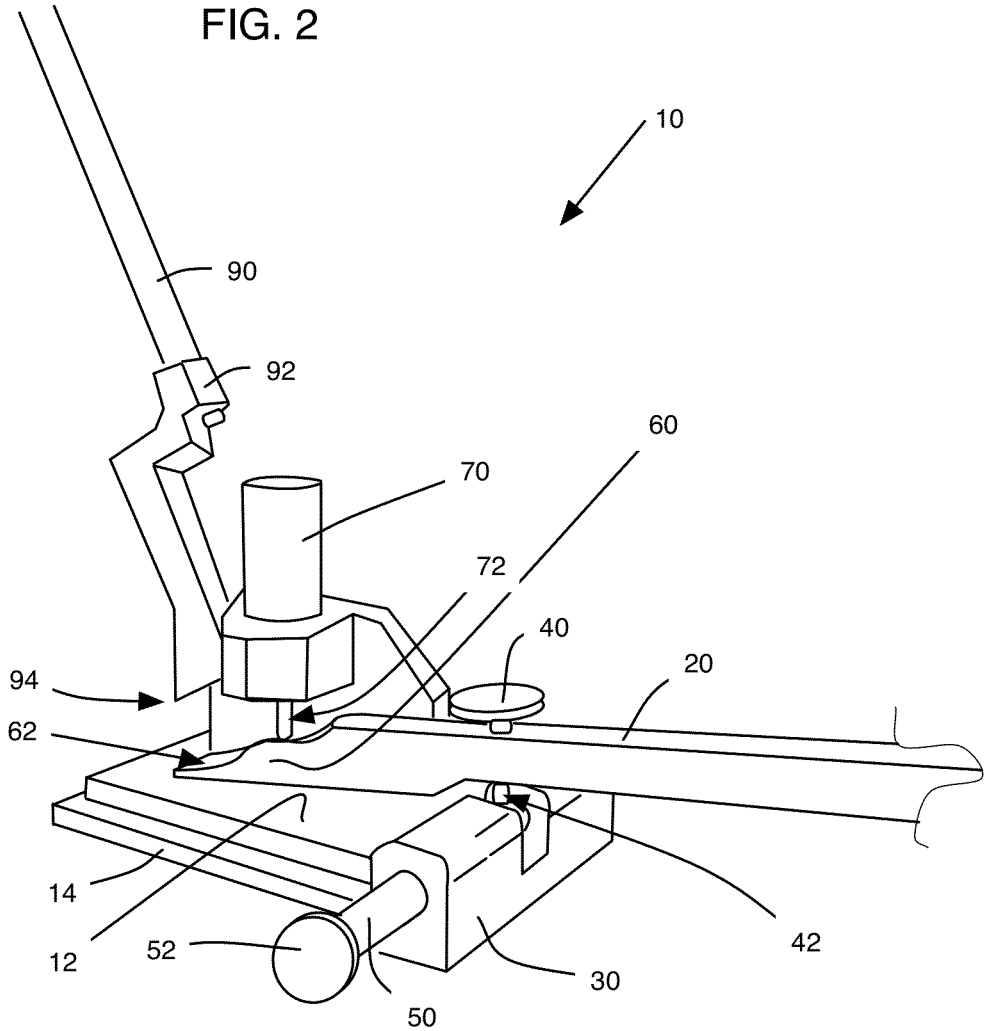
FIG. 2 is an offset side view of the embodiment of FIG. 1.
Figure 3:
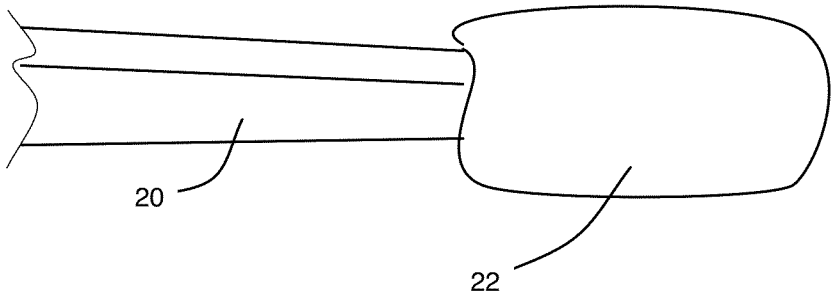
FIG. 3 is a partial view of the arm of the embodiment of FIG. 2.
Figure 6:
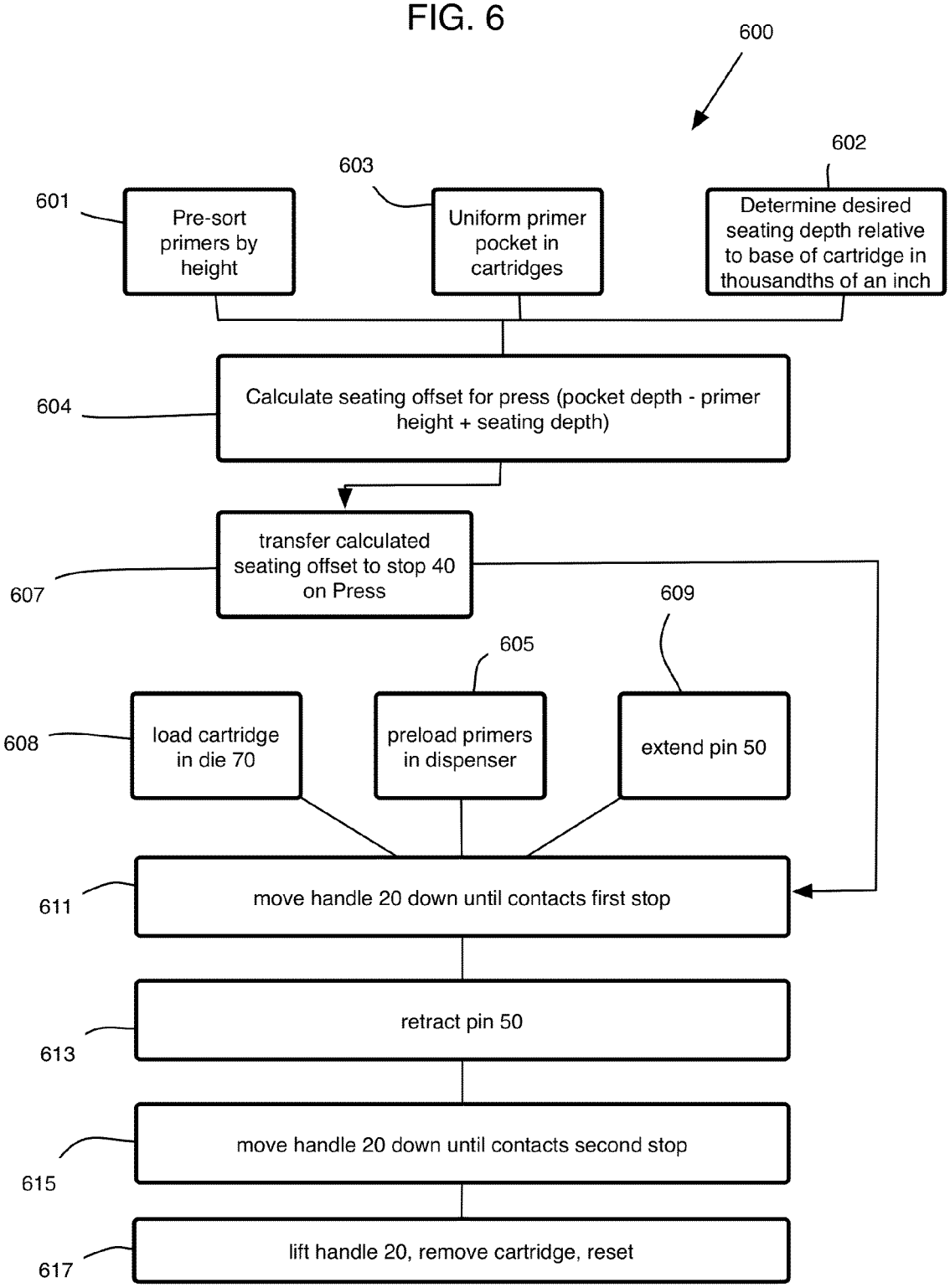
FIG. 6 is a block diagram of another preferred method of the present invention.

FIG. 6 illustrates one preferred method of the present invention. This method 600 uses the devices previously discussed, above, as illustrated in FIGS. 1-3. Accordingly, one step in a preferred method 600 of the present invention requires the hand-reloader to sort primers 601 according to height. Next, the primer pockets in each cartridge must be made uniform 603. Standard carbide uniformers from, for example, Sinclair International, can be used as would be generally understood in this art. When uniforming the cartridges, a depth setting of 0.132 to 0.133 inches is preferred for large rifle and magnum primers, and a depth setting of about 0.123-inches is preferred for small rifle cartridges such as PPC, BRs, 6.5×47, and 0.308-caliber. Finally, the reloader must decide 602 the desired resultant seating depth of the primer relative to the base of the cartridge. Typically, the reloader would select "at crush", which would be even with the base of the cartridge having an offset of about 0.000-inches. Or, a below crush of 0.001 to about 0.002-inches below the surface (extended inside the cartridge, a factor of +0.001 or +0.002, respectively). Or, an above crush of about 0.001 to 0.002-inches (standing proud relative to the base of the cartridge, having an offset factor of −0.001 or −0.002-inches). This "offset factor" is explained below.

Using the depth of the primer pocket obtained in the uniforming step 603, the pre-determined height of the primer obtained in step 601 and the desired primer depth (step 602), a seating offset can be calculated (step 604). This seating offset dimension will be transferred later to the press, as explained below.

The seating offset is determined 604 by taking the primer pocket depth and subtracting the height of the primer, then adding the offset factor. For example, if a reloader desires a "below crush" seating of 1-one thousandths of an inch (a nominal +0.001 offset factor), using a primer having a height of 0.128-inches in a primer pocket of 0.132-inches, the seating offset would be 0.132−0.128+0.001=0.005. This offset factor is 5-thousandths of an inch and this dimension is transferred 607 to the press stop 40 by turning the handle 5 turns, where each full turn represents one-one thousandths of an inch, for example.

Once set up, the primer seating press precisely seats primers in cartridges based on a perfect measured seating depth, which eliminates the old feel technique currently used in the art.

For example, a popular primer currently used in the art is a Federal-brand 210M (model) primer. This primer requires that the primer pocket of the brass cartridge be uniformed at a depth of 0.132 inches. This primer, from the pre-sorting step, results in primer heighted measured at 0.128-inches. Further the proper seating of this primer is flush with the base of the cartridge. Therefore to obtain a flush seating of the primer (relative dimension of primer seat to base of the cartridge is 0.000-inches), the stop must be set at 0.004-inches (the subtraction of the pocket of 0.132 from the primer height 0.128). This measured dimension does not require the old feel method. Rather, this 0.004 dimension (in this example) is simply transferred to the primer seater device 10 by turning the stop 4 complete turns clockwise, causing the threaded portion of the stop to extend 0.004-inches from the nominal position. Now, when seating the sorted primers in previously uniformed cartridges, the hand-releader need now only move the lever of the press down until the stop contacts the bar. This gives a repeatable seating depth on each cycle of the press.

Common nominal primer heights include Federal 210M primers at 0.128 inches, Rem. 9-½ primers at 0.132-inches, Winchester LR primers at 0.128-inches, Federal 2015M primers at 0.121-inches, Rem. 9-½M at 0.132-inches, Rem. 7-½BR at 0.122-inches, and CCi 450 primers at 0.120-.121, for example. However, the actual height in a given batch of primers may range around the nominal dimension, thus the need for a measured pre-sorting of the primers.

The cartridges used need to be made uniform 603 by setting the primer pocket depth to a certain dimension. Cartridge brass can be made uniform by using a carbide uniformer, which is a tool that is commercially available and those skilled in the art will be familiar with such uniformers. On all large rifle and magnum primers a depth of about 0.132 to about 0.133-inches is preferred. On small rifle, PPC, BRs, 6.5×47 and 308 small rifle brass a depth of about 0.123-inches is best.

Further, to improve primer seating in a way that matches each hand-reloaded cartridge to a specific firing chamber, the present invention further contemplates a device (see, for example, FIGS. 1-3) for improved primer seating in a hand-loaded cartridge. The primer seating device includes a base-plate adapter 30 configured to receive a selectively slideable cross pin 50, which is configured to slide from an open to a closed position in a slot in the base-plate adapter; an arm 20 configured to hingeably travel in and out of the slot in the base-plate adapter depending on whether the cross pin is open or closed. And, the arm 20 further includes at a proximal end a combination die-piston pushing element and primer-loading trigger element 60.

To set up the primer seating die and press device 10 to a desired seating depth using the seating offset, explained above, the stop 40 is turned, for example, clockwise four complete turns from the nominal position, representing 0.004-inches in offset (determined in steps 601, 602, 603, and 604, as previously discussed). When the stop 40 contacts the pin 50 (in the extended position) the press piston stops vertical travel and the trigger 60 stops as well, which stops seating the primer at the exact desired seating depth.

A primer seating die is adapted and configured to selectively hold a cartridge housing, the primer seating die includes a shell holder (as would be conventionally understood by those skilled in the art) that secures the cartridge in place during seating. A conventional press includes a piston, which is configured and arranged to extend and retract within the primer-seating die (over the seating stem) to seat the primer in the cartridge. Further, an arm on the conventional press motivates the up and down travel of the piston, conventionally, as would be understood by those skilled in this art. The range of travel of the piston can be adjusted by using a stop 40. The stop includes a threaded member configured to contact the cross pin. The treaded member can include a thread pitch whereby one complete rotation of the handle equates to 0.001-inch vertical travel. A nominal position can be indicated on the threaded member.

Then, moving downward the arm 20 of the press, which is holding the primer-seater die. Further, the press can include a primer pick up, as would be well understood by those skilled in this conventional art of hand reloading using a press. The reloader (manually) retracts the cross pin, thus enabling the piston to travel the full length of a downward stroke (this length was predetermined in set up and is controlled by the stop). Once the piston has fully traveled downward and the primer has been picked up and is ready to be placed on the primer-seater die, the arm is moved up, causing corresponding upward travel of the piston, thus placing the primer in the primer seating die. Next, with the press arm in the full upward (top) position the cross pin is closed (extends), which will limit the second downward stroke of the piston. The hand-loader now places a cartridge in the primer-seating die, which is pre-loaded with a primer (from the steps, above). Now the arm is pulled downward (causing the piston to travel downward as well) until its limit is reached (by contacting the cross pin, which prevents further downward travel, as explained above). This second downward stroke precisely seats the primer in the cartridge at a predetermined depth by pushing the primer upward into the base of the cartridge (as would be conventionally done, but now the limit of the upward travel of the trigger element 60 is controlled by the stop 40 and pin 50.

The seating press 10 includes several unique components that cooperate to precisely and repeatably seat primers in cartridge shells. The seating press 10 includes a base-plate adapter 30 and adjustable stop 40. The stop 40 is configured to, and otherwise allows for improved function as well as governing the primer depth of all center-fire cartridges.

Figure 5:
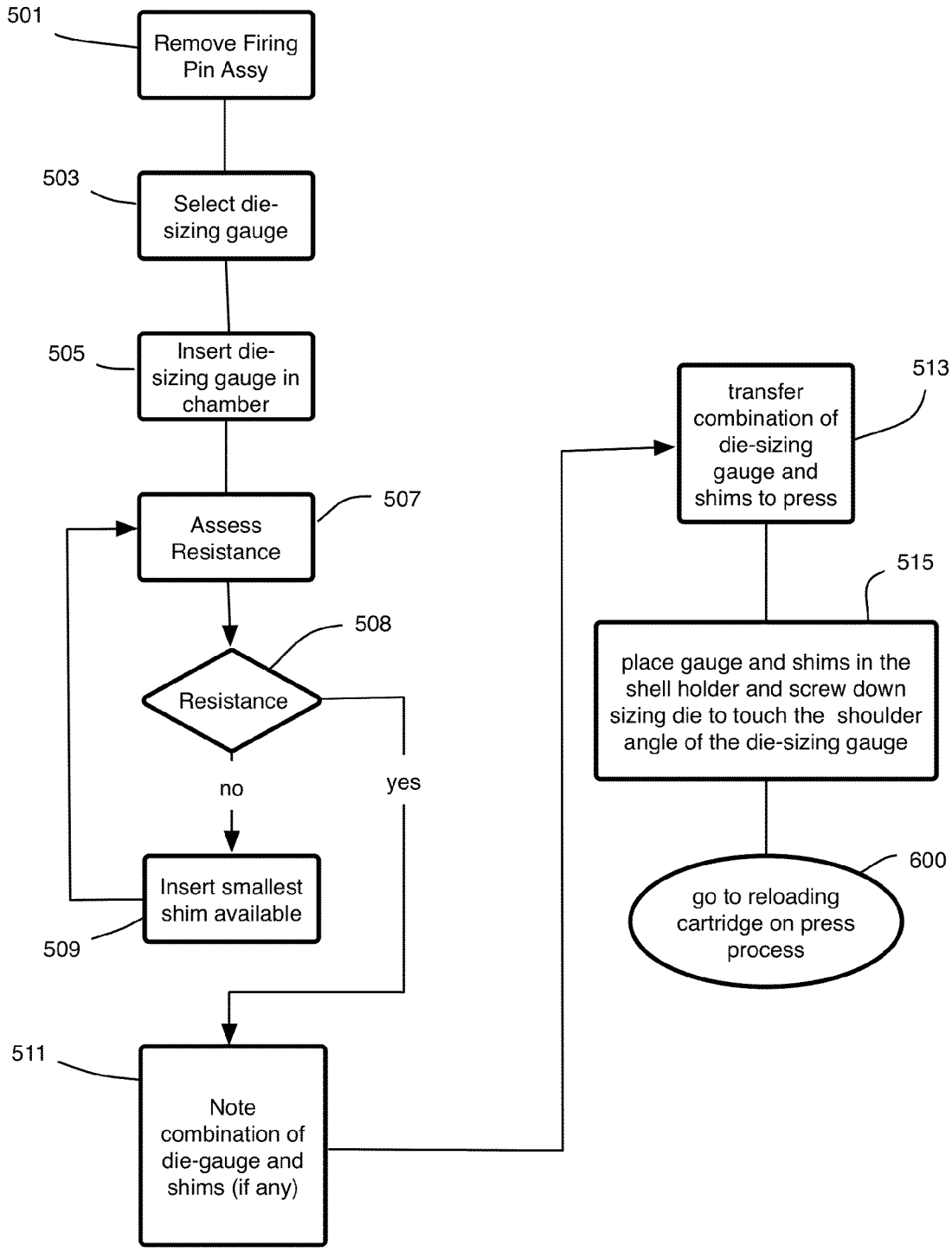
FIG. 5 is a block diagram of a preferred method of the present invention.

The infinitely adjustable physical stop 40 is arranged in the seating arm 20 of the seating press 10. The physical stop 40 is preset by the reloader to a given, predetermined location, which prevents over travel of the handle, and thus prevents over insertion of the primer in a cartridge. The physical stop is set to its predetermined position by translating the firing position of the firearm relative to the rim dimension of a cartridge by using a set of reloading shims and a reloading gauge-die as discussed in a preferred method, below (see also, e.g., FIG. 5).

The seating press device 10 includes a base plate 12 and base-plate adapter 30, which configures to support the press and couple the press to the base plate. The base plate adapter 30 further is configured to receive a selectively slideable cross pin 50. At one end of the cross pin 50, a large knob 52 positions to enable a user to easily pull or push the slide pin in and out of the corresponding slot in the adapter 30. The cross pin slides from an open to a closed position in this slot 34 in the adapter 30. When in the closed position, the slide pin 50 restricts the downward travel of the handle 20. When the pin 50 is in the open position, the arm 20 is free to fully travel downward until it contacts a bottom shelf 36 on the adapter. This cross pin 50, in the closed (extended) position prevents a primer in the primer loader from dispensing, which prevents unintended dispensing of the primer, jamming of the device, and otherwise wasting productivity.

The handle 20, at a distal end, includes a gripping element 22, and at a proximal end, a combination die-piston pushing element and primer-loading trigger element 60. This element 60 includes a distal tip 62 configured to engage the stock of primers 90 in the primer loader 92 by engaging the loader at engaging arm 94: However, for element 60 to engage arm 94, the cross pin 50 must be in the retracted (or open) position.

A seating die 70 is configured to selectively hold a cartridge case in a shell holder (not shown in the drawing—but those skilled in the art will appreciate conventional reloading die sets function essentially the same as contemplated by the present invention). As would be understood in this art, the reloading die includes a conventional feature that secures the cartridge in place during seating, as would be well-understood in this art.

A piston 72 configures to extend and retract within the shell holder to seat the primer in the cartridge. The arm 20 moves up and down and causes corresponding articulation of the piston by means of the element 60, which is in contact with the piston.

Adjustable limits on the travel of the arm 20 are controlled by the stop 40. The positioning of the stop 40 is predetermined by the method described below (see also FIG. 6). To aid in a precise setting of the stop's vertical position, the stop includes a threaded member 42 whereby each full turn of is one one-thousandth's of an inch, for example. And the threaded member 42 configures to contact the slide pin 50 when in the closed or extended position. This stop restricts downward travel of the arm 20. The stop extends through arm 20. The bottom of the stop selectively engages the cross pin 50 (when extended) or, alternately, the shelf 36 when pin 50 is retracted. This limit on the downward travel of arm 20 caused by stop 40 translates into a limit of (upward) travel of the piston by means of piston-engaging element 60. Thus, the hard stop created by stop 40 prevents over travel of the seating operation by physically restricting travel of the primer relative to the cartridge in the die 70. Thus, the user (reloader) of the seating press does not need to feel the seating of the primer. Guesswork is eliminated and the primer can be seated precisely and repeatably.

To further improve efficiency with reloading multiple cartridges of the same caliber for a given firearm, the seating press device 10 includes mechanisms for batch loading a plurality of primers. Such primer loading rail devices are well understood in the art, and includes a means for loading a plurality of primers into a dispensing apparatus, the dispensing apparatus is configured to dispense one primer from the bottom of the apparatus (gravity fed) when the piston articulates (upward travel of the piston); thus positioning the primer in an orientation suitable for pressing into a cartridge. This primer-loading device includes a stack of primers to be seated 90 and a primer setting tool 92, as would be conventionally understood.

A cartridge inserts into the cartridge holder and seating cup 80, which conventionally positions on the die 70. The reloader hand loads one empty cartridge into the seating die 70 and removes the primer-seated cartridge upon completion of the cycle.

The downward articulation of the arm 20 allows for primer pick up. The cross pin 50 is retractable, and must be retracted by hand by the reloader to allow primer pick up. Once the primer has been loaded into the seating cup 80, the cross pin 50 is engaged by pushing it inward to the closed position and becomes a seating stop for the stop 40, which includes an adjustable screw 42 that is located in the improved handle design. The screw dial 41(not numbered in drawing, pah to add) allows the user to adjust the seating depth of the primer based on the thickness of the extraction rim that is precisely machined into the cartridge case. A dial indicator can be used to measure the preferred seating depth "flush or below the case head" in thousandths of an inch when developing the perfect load and this can be transferred to the adjustable stop by turning the threaded portion clockwise or counterclockwise as appropriate. In a preferred embodiment, a constant offset of 0.002-inches is subtracted from the unique combination of the present invention's reloading die and reloading shim combination as predetermined for a given firearm and cartridge size. By using the reloading die and reloading shim according to the discussion, above, the reloader can be assured of a precise and accurate dimension to which the seating die is set and to which the stop is adjusted. This ensures that each hand-loaded cartridge includes proper placement of the primer so that the firing anvil contacts the primer in precisely the same location from cartridge to cartridge—thus avoiding a cushioned blow (too shallow) or a too high blow.

Once the primer is seated, the cross pin 50 is retracted (pulled outward to its fully open position) and the arm 20 is now free to extract another primer from the feeding tube. A torsion return spring applied to the improved handle allows 20 for quicker handle return and speeds up the seating process by eliminating a hand operation.

The base plate 12 can be machined from a billet, extruded from a die, or investment cast. The flat plate houses 4 tapped holes to secure a conventional reloading press, such as an RCBS unit, to the adapter plate.

Although the invention has been particularly shown and described with reference to certain embodiments, it will be understood by those skilled in the art that various changes in form and detail may be made without departing from the spirit and scope of the invention.

I claim:

1. A system for hand-loading cartridges for use in a predetermined firing chamber, the system comprising:

a primer-seating press device comprising an arm hingeably configured to operate in a first upward position, a second intermediate position, and a third downward position;

a cross pin disposed on the primer-seating press, the cross pin configured horizontally and configured to selectively slide from a retracted position to an extended position whereby in the retracted position the arm can operate from the first upward position to the third downward position and whereby in the extended position the arm can operate from the first upward position to the second intermediate position;

an adjustable stop disposed on the arm whereby the stop can be set to a predetermined height whereby travel of the arm to either the second intermediate position or the third downward position is restricted by the predetermined height wherein the stop configures to contact the cross pin in the extended position and a shelf when the cross pin is in the retracted position, and wherein the shelf is a horizontal surface disposed on the press; and a piston arranged vertically on the primer-seating press and operable from a first position to a second position and to a third position whereby each position corresponds to travel by the arm.

2. The system of claim 1 further comprising:

at least one reloading sizing-die gauge adapted to selectively insert into the chamber; and at least one reloading shim adapted to selectively insert into the chamber and cooperate with the reloading sizing-die gauge whereby the chamber size can be represented by any combination of the at least one reloading sizing-die gauge and the at least one reloading shim.

3. The system of claim 1 wherein the primer-seating press further comprises:

a seating stem arranged in line with the piston, the seating stem configured to receive the cartridge;

a primer dispenser adapted to dispense at least one primer in relation to the seating die and whereby upward travel of the piston causes the primer to seat in the cartridge at a predetermined seating height defined by the third position of the piston.

4. A primer-seating press device for seating a primer in a cartridge, the device comprising:

an arm hingeably configured to operate in a first upward position, a second intermediate position, and a third downward position;

a cross pin disposed on the primer-seating press, the cross pin configured horizontally and configured to selectively slide from a retracted position to an extended position whereby in the retracted position the arm can operate from the first upward position to the third downward position and whereby in the extended position the arm can operate from the first upward position to the second intermediate position;

an adjustable stop disposed on the arm whereby the stop can be set to a predetermined height whereby travel of the arm to either the second intermediate position or the third downward position is restricted by the predetermined height wherein the stop configures to contact the cross pin in the extended position and a shelf when the cross pin is in the retracted position, and wherein the shelf is a horizontal surface disposed on the primer-seating press; and a piston arranged vertically on the primer-seating press and operable from a first position to a second position and to a third position whereby each position corresponds to travel by the arm.

5. The device of claim 4 further comprising:

a seating die arranged in line with the piston, the die configured to receive the cartridge;

a primer dispenser adapted to dispense at least one primer under the cartridge whereby upward travel of the piston causes the primer to seat in the cartridge at a predetermined seating height defined by the third position of the piston.

6. A method for reloading a cartridge including seating a primer in the cartridge, the method comprising:

calculating a seating offset;

transferring the seating offset to a stop on a primer seating press providing the primer-seating press whereby the primer-seating press comprises an arm hingeably configured to operate in a first upward position, a second intermediate position, and a third downward position;

a cross pin disposed on the seating press, the cross pin configured horizontally and configured to selectively slide from a retracted position to an extended position whereby in the retracted position the arm can operate from the first upward position to the third downward position and whereby in the extended position the arm can operate from the first upward position to the second intermediate position;

the adjustable stop is disposed on the arm whereby the stop can be set to a predetermined height whereby travel of the arm to either the second intermediate position or the third downward position is restricted by the predetermined height wherein the stop configures to contact the cross pin in the extended position and a shelf when the cross pin is in the retracted position, and wherein the shelf is a horizontal surface disposed on the primer-seating press; and a piston arranged vertically on the primer-seating press and operable from a first position to a second position and to a third position whereby each position corresponds to travel by the arm.

7. The method of claim 6 further comprising:

removing a firing pin assembly from the predetermined firing chamber;

selecting a reloading die from a set;

inserting the reloading die into the chamber;

closing a bolt on the firing chamber and assessing the resistance of the bolt as it closes;

determining if a reloading shim is needed;

noting the combination reloading die and reloading shim; and transferring the reloading die and reloading shim.

8. The method of claim 6 further comprising:

placing a cartridge in the die on the primer-seating press;

providing at least one primer; and seating the at least one primer in the cartridge using the primer-seating press.

9. The method of claim 6 further comprising:

presorting at least one primer by height.

10. The method of claim 6 further comprising:

uniforming at least one primer pocket.

11. The method of claim 6 further comprising:

determining a desired seating height relative to the base of the cartridge.

* * * * *